United States Patent [19]

Harrop et al.

[11] Patent Number: 4,842,214

[45] Date of Patent: Jun. 27, 1989

[54] ADAPTOR FOR TWIST FRAME FORMING TUBE

[75] Inventors: Kenneth T. Harrop; Ray T. Carver, both of Aiken, S.C.

[73] Assignee: Owens - Corning Fiberglass Corp., Del.

[21] Appl. No.: 112,197

[22] Filed: Oct. 26, 1987

[51] Int. Cl.[4] ..... B65H 49/20

[52] U.S. Cl. ..... 242/130; 242/131

[58] Field of Search ..... 242/130, 130.1, 129.5, 242/129.7, 129.71, 131, 131.1, 134, 141, 46.6, 46.2, 46.3; 57/90

[56] References Cited

U.S. PATENT DOCUMENTS

| | | | |
|---|---|---|---|
| 2,574,285 | 11/1951 | Rea | 242/130.1 X |
| 2,891,739 | 6/1959 | Wolfe | 242/110 |
| 2,930,542 | 3/1960 | Cocker, III | 242/130 |
| 3,136,498 | 6/1964 | Carroll | 242/130 |
| 3,430,892 | 3/1969 | Heumann | 242/129.5 |

*Primary Examiner*—Stanley N. Gilreath

[57] ABSTRACT

The present invention relates an improved creel adaptor for use in retaining a forming tube containing formed glass fiber during the twist process. The improved creel adaptor is designed to maintain a forward outside diameter slightly smaller than the rear outside diameter, wherein the forming tube is placed on the creel adaptor and maintained in position by the variation in the outside diameter of the creel adaptor.

4 Claims, 3 Drawing Sheets

ADAPTOR FOR TWIST FRAME FORMING TUBE

BACKGROUND OF THE INVENTION

The present invention relates an improved creel adaptor for use in retaining a tube containing formed glass fiber during the twist process in the manufacture of glass fiber textile products. The improved creel adaptor of the present invention is designed to be positioned on a twist frame and accept the forming tubes received from the glass fiber forming operation. The creel adaptors rotate during the fiber twist operation, to transfer and twist the glass fiber onto a rotating bobbin. A recurring problem in the twist operation is presented wherein the forming tubes tend to walk or slide off of the creel adaptor while the adaptor rotates, causing strand misalignment and interference in personnel and machinery movement between adjacent twist frames.

It is not unusual for 10% or more of the forming tubes run on an individual twist frame to extend from 3 to 5 inches beyond the front of the creel adaptor during the twist operation. Such walking creates undersirable inefficiencies in the twist process due to the ends of the tube breaking out. Also, walking tubes tend to create a misalignment of the strand between the forming tube and the bobbin. This causes poor processing and product quality problems. Further, common twist operations include a plurality of twist frames placed back to back in spaced relationship with narrow aisles between the frames. There are narrow aisles between the fronts of the twist frames to allow for operator passage. When the forming tubes shift or walk on the creel adaptors into the aisle, the movement of people and/or machinery between the frames is undesirably restricted.

Past attempts to correct these problems have focused on geometrically coordinating the outside diameter of the adaptor with the inside diameter of the tube within close tolerances to provide a proper fit and help prevent walking. These attempts have met with limited success due to the inability to properly and continuously match the correct diameter to maintain a close fit. Since the forming tubes weight 20–30 pounds and must be elevated by the operator to a level of five or six feet for loading on a twist frame, a close fitting adaptor/tube tolerance creates difficulty for the operators. Applicants' invention overcomes these loading/unloading difficulties and prevents walking of the forming tube on the creel adaptor during the twist operation.

SUMMARY OF THE INVENTION

The present invention provides a solution to the problems created by walking forming tubes on twist frame processing stands. The invention provides for the diameter of the back portion of the creel adaptor to be slightly larger than the diameter of the front portion of the creel adapter. This variance in diameter causes the forming tube to remain in position or attempt to walk towards the back of the creel adaptor. Additionally, diameter variance of the creel adaptor provides for enhanced ease of loading and unloading for the operator when placing the forming tubes on the adaptor.

This present invention comprises a creel adaptor having a tapered outside diameter with a reduced front diameter. The invention provides the creel adaptor with an adjustable outside diameter wherein the front outside diameter is maintained incrementally smaller than the rear outside diameter.

DESCRIPTION OF THE PREFERRED EMBODIMENTS

The present invention relates an improved creel adaptor intended for use in twist frame operations. During the manufacture of glass textile fiber, the drawn glass fiber product is wound onto forming tubes for storage and transfer to the twist frame operation wherein the glass fiber is twisted into its final form and placed on bobbins for transfer to end-use production lines. The forming tubes containing the wound glass fiber textiles are placed onto creel adaptors which are rotated to transfer the glass fiber from the forming tube to the bobbin.

Figure 1:
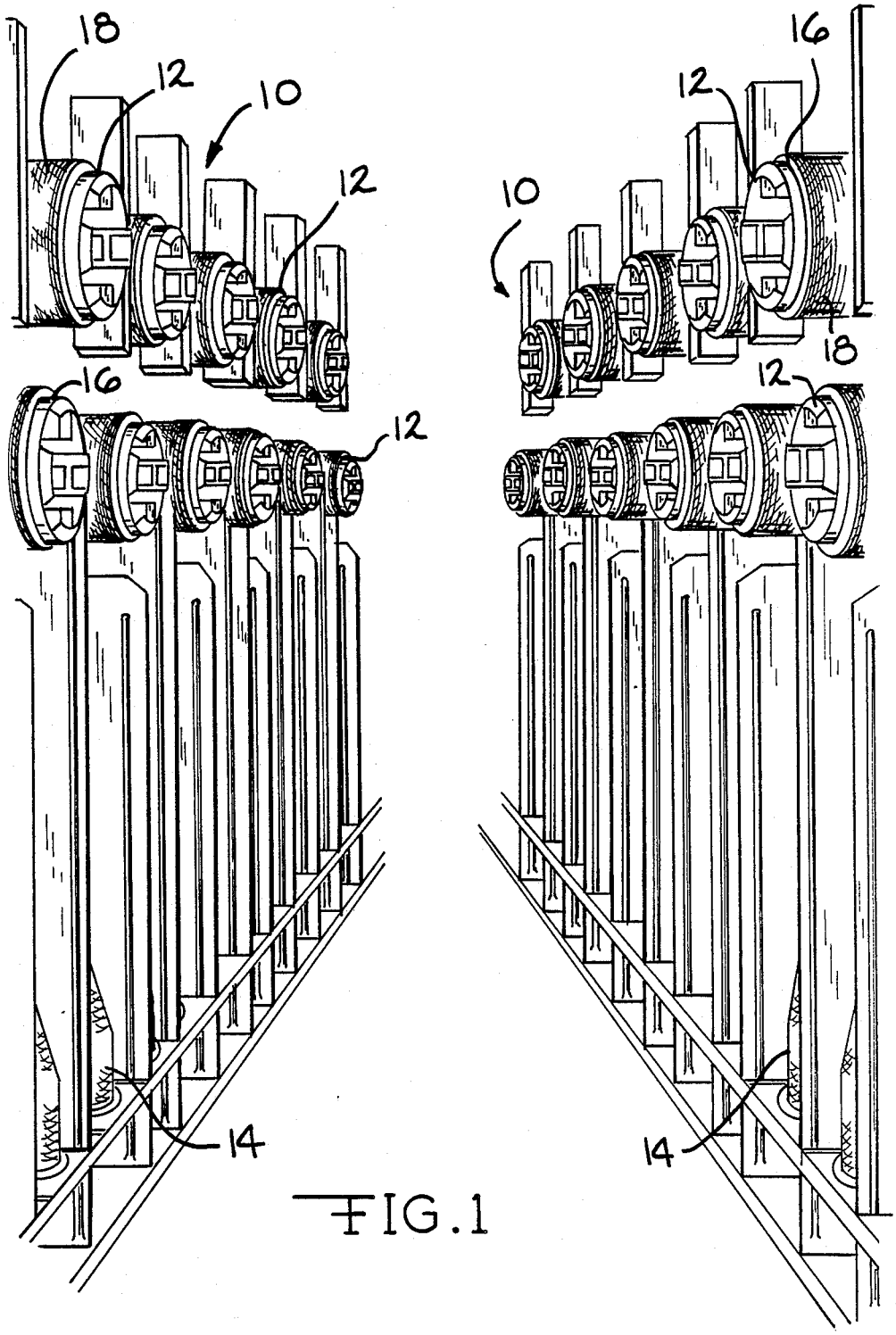
FIG. 1 is a view of a pair of twist frames having an aisle between the frames.

Referring now to FIG. 1, the twist frame operating centers generally contain a plurality of twist frames 10 which in turn contain a plurality of creel adaptors 12 and unwind and twist mechanisms (not shown). The twist frames 10 are typically forty to sixty feet long, four feet wide and seven feet high. The twist frame 10 is double sided in operation and typically has from forty-eight to fifty creel adaptors 12 per side. The twist frames 10 are lined up side by side in rows with approximately three feet between frames 10 to allow an operater to push a truck between the rows. The truck is used to carry th forming tubes 16 to and from the twist frames 10. The twist frames include the creel adaptor 12 which receives the forming tube, the unwind and twist mechanism (not shown) and a bobbin 14. During the twist process, the creel adaptors 12 are rotated by motors (not shown) feeding the glass yarn 18 from the tube 16. The yarn 18 is twisted by the unwind and twist mechanism as it is wound onto the bobbin 14.

Figure 2:
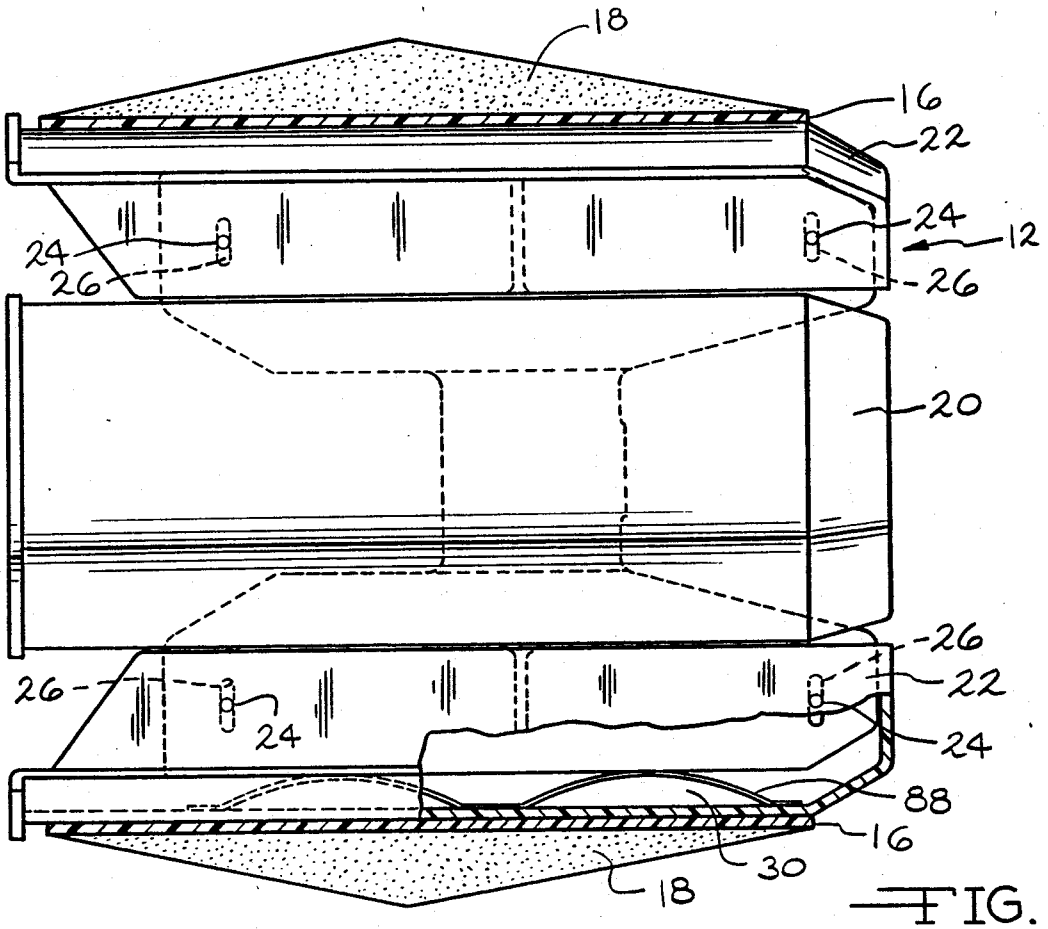
FIG. 2 is a side view of a creel adapter with a cutaway showing internal details of the present invention.
Figure 3:
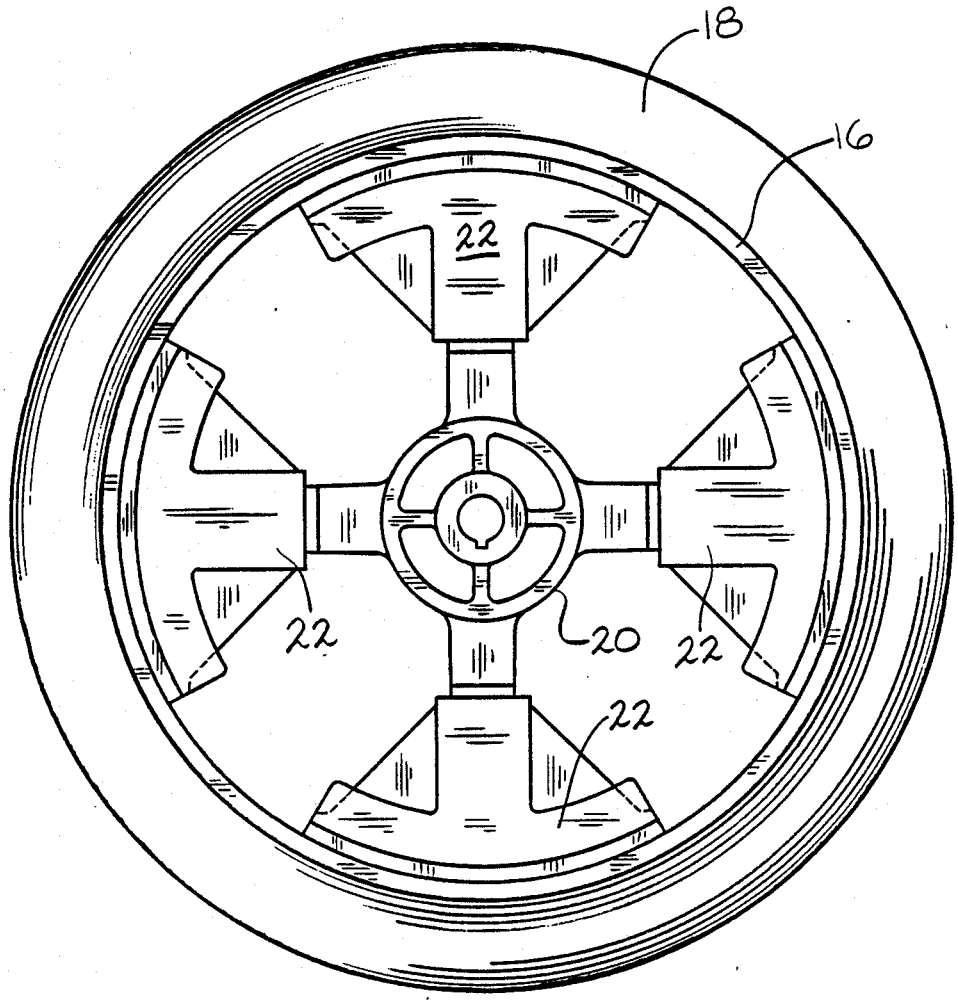
FIG. 3 is a front view of a creel adaptor of the present invention.

The creel adaptor 12 generally consists of a center hub or spider 20 and commonly has four fingers or caps 22 that are mounted on the hub 20 and extend radially outward. The fingers 22 are resiliently movable on the hub 20 and compress toward the hub 20 when the forming tube 16 is placed on the adaptor 12. FIG. 2 shows the use of a leaf spring 88 positioned in a cavity 30 located between the spider 20 and fingers 22, however, sponge rubber or any other element having a resilient nature may be used. Each of the four fingers 22 are held in place on the hub 20 by roll pins 24 located proximate the front of each finger 22 and pins 24' located proximate the rear of each finger 22. The roll pins 24, 24' engage with a slot 26 located in the hub 20. The roll pin 24, 24' slot 26 combination allows the fingers 22 to expand and contract about the hub 20 enabling the creel adaptor to receive and snugly engage tubes 16 of a specified inner diameter which is larger than the maximum front edge diameter of the creel adaptor and no larger than the maxiumum rear edge diameter of the creel adaptor.

The present invention provides a front roll pin 24 of larger diameter than the rear roll pin 24 in each of the adaptor fingers 22. The larger diameter pin 24 prevents the front of the finger 22 from expanding outward as far as the rear of the finger 22. Thus, the diameter of the front of the adaptor 12 will always be slightly less than the inside diameter of the forming tube 16 and the rear diameter of the adaptor 12 after the forming tube 16 has been placed thereon. The smaller diameter in the front of the creel adaptor 12 facilitates ease of loading and unloading of the forming tubes 16 and creates an environment wherein the forming tube 16 tends to walk toward the larger rear diameter on the adaptor 12. Thus the forming tube continuously tries to push towards the rear of the adaptor 12, thereby maintaining strand placement within the twist frame 10 mechanism.

The above description of the preferred embodiments of the present invention is intended to be explanatory in scope and is not intended to be limiting on the scope of the following claims.

We claim:

1. An improved twist frame creel adaptor having a front edge and a rear edge for receiving a cylindrical forming tube having an inner surface of specified inner diameter containing wound glass fiber product and for rotating such cylindrical forming tube to unwind such glass fiber product comprising in combination:

a rotatably driven central hub member;

a plurality of finger members engaged with said hub member; and, means for orienting said finger members to form an outer surface to receive such cylindrical forming tube wherein the front edge of said adaptor is of a diameter slightly less that such specified inner diameter of such cylindrical forming tube and such rear edge of said adaptor is of a diameter larger than said front edge diameter to engage such inner surface of said cylindrical forming tube.

2. The creel adaptor of claim 1, further including a resilient means positioned between said finger members and said hub member, said resilient means designed to urge said finger members outward from said hub member into a tight connection with such cylindrical forming tube while maintaining said first outside diameter smaller than said second outside diameter.

3. An improved twist frame creel adaptor having a front portion and a rear portion for use in receiving forming tubes containing glass fiber product by sliding such forming tube from such front portion to such rear portion comprising, in combination: a central hub member; a plurality of finger members engaged with said hub member, said finger members extending radially outward from said hub member; said hub member including a plurality of front and rear slots proximate such front and rear portions; said finger members including front and rear pins for engaging said front and rear slots of said hub member, said front pins having a larger outside diameter than said rear pins; wherein said finger members form a first outside diameter at such front portion and a second outside diameter larger than said first outside diameter at such rear portion.

4. An improved twist frame creel adaptor having a front edge and a rear edge for receiving a cylindrical forming tube having an inner surface of specified inner diameter containing wound glass fiber product and for rotating such cylindrical forming tube to unwind such glass fiber product comprising in combination:

a rotatably driven central spider member having at least two radially extending arms, each arm having a radial slot proximate such front edge and a second radial slot proximate such rear edge;

at least two finger members, each of said finger members engaged with one of said arms for radial movement to form a circumferential surface around said spider member, each of said finger members including a front pin for engaging one of said front slots of said spider and a rear pin for engaging one of said rear slots of said spider; said front pins being of larger diameter of said rear pins; wherein said finger members form a first outside diameter at such front edge smaller than such inner diameter of such cylindrical forming tube and a second outside diameter larger than said first outside diameter at such rear edge.

* * * * *